United States Patent [19]

Uchida et al.

[11] 4,037,992

[45] July 26, 1977

[54] SLURRY CONTINUOUS PRESSURE-FEEDING APPARATUS

[75] Inventors: Kenji Uchida, Kashiwa; Kenichi Fujita, Tokyo, both of Japan

[73] Assignee: Hitachi, Ltd., Japan

[21] Appl. No.: 609,051

[22] Filed: Aug. 29, 1975

[30] Foreign Application Priority Data

Nov. 25, 1974 Japan ..... 49-134279

[51] Int. Cl.[2] ..... F04F 11/00

[52] U.S. Cl. ..... 417/102; 417/103; 417/900

[58] Field of Search ..... 417/126–136, 417/101, 102, 103, 92, 900, 85, 86, 1, 2, 244, 248, 426, 286, 149, 390; 60/428, 430

[56] References Cited

U.S. PATENT DOCUMENTS

| | | | |
|---|---|---|---|
| 474,053 | 5/1892 | Bennett | 417/102 |
| 570,357 | 10/1896 | Waller | 417/92 |
| 2,478,321 | 8/1949 | Robbins | 417/103 |
| 2,638,973 | 5/1953 | Carey | 417/216 X |
| 2,704,034 | 3/1955 | Jones | 417/102 |
| 3,556,682 | 1/1971 | Sakamoto et al. | 417/102 |
| 3,584,977 | 6/1971 | Coleman et al. | 417/2 X |

*Primary Examiner*—William L. Freeh
*Assistant Examiner*—Edward Look
*Attorney, Agent, or Firm*—Craig & Antonelli

[57] ABSTRACT

With a slurry continuous pressure-feeding apparatus wherein normally three feed chambers alternatively operate to continuously pressure-feed the slurry, in the case of continuously pressure-feedingthe surry by using two feed chambers, the same amount of slurry as in the case of three feed chambers can be pressure-fed by operating an auxiliary slurry pump installed in parallel with a slurry pump. Some portions of piping systems maintained with the feed chambers are formed with bending pipes which absorb expansion or contraction of the piping systems due to thermal expansion of the piping systems and the fluidic pressure of a fluid flowing through the interiors of the pipes. A float formed in the form of a cylindrical body closely attachingly provided at both upper and lower ends thereof with bowl-shaped end plates, is inserted into the respective feed chambers.

9 Claims, 14 Drawing Figures

SLURRY CONTINUOUS PRESSURE-FEEDING APPARATUS

This invention relates to an apparatus for continuously pressure feeding the slurry.

As shown in FIG. 1, a slurry continuous pressure-feeding apparatus produced according to the prior art comprises a plurality of feed chambers 1 to 3 disposed in parallel with one another and provided therein with floats $F_1$ to $F_3$, a high pressure pump LP for delivering the driving liquid into the feed chambers 1 to 3, a slurry pump SP for delivering the slurry into the feed chambers 1 to 3, check valves $B_1$ to $B_3$ and $D_1$ to $D_3$ provided respectively on slurry inflow pipes 4 to 6 and out flow pipes 7 to 9 and change-over valves $A_1$ to $A_3$ and $C_1$ to $C_3$ provided respectively on driving liquid inflow pipes 10 to 12 and outflow pipes 13 to 15, position detectors $SH_1$ to $SH_3$ and $SL_1$ to $SL_3$ for detecting positions of floats $F_1$ to $F_3$, a waiting-time timer 16 for actuating said respective position detectors, and flow controller $FC_1$, $CV_1$ and $FC_2$, $CV_2$ for controlling inflow and outflow amounts of the driving liquid.

When the slurry pump SP is driven to deliver the slurry from a tank ST into the feed chamber 1 through the inflow pipe 4 so as to elevate the float $F_1$, the driving liquid on top of the float $F_1$ returns to a tank OT through the outflow pipe 13. When the detector $SH_1$ detects the uppermost position of the float $F_1$ at the time of outflow of said driving liquid, the change-over valve $C_1$ is closed and the change-over valve $A_1$ is opened, to thereby permit the driving liquid to flow into the feed chamber 1 to urge the float $F_1$, whereby the slurry under the float $F_1$ is pressure-fed through the outflow pipe 7.

When the detector $SL_1$ detects the lowermost position of the float $F_1$ at the time of pressure-feeding of the slurry, the change-over valve $A_1$ is closed and the change-over valve $C_1$ is opened, thereby repeating the same actions as above, whereby the slurry in continuously pressure-fed. The slurry is continuously pressure-fed if said actions can be performed successively and continuously in reference to the respective feed chambers.

However, it is extremely difficult to have the inflow amount $Q_1$ of driving liquid (or the outflow amount $Q_4$ of slurry) and the outflow amount of $Q_2$ of driving liquid (or the inflow amount $Q_3$ of slurry) correspond with each other perfectly. If $Q_2$ is larger or less than $Q_1$ even slightly, the slight balances accumulate, with the result that eventually the change-over valves C are opened prior to closing of the change-over valves A, for example. In that case, the driving liquids in the feed chambers return to the tank OT at the side of the high pressure pump LP through the change-over valves C, the slurry pump SP performs cut-off operation and the flow of $Q_1$ is interrupted, thus causing a percussion due to water impact. It is impossible to continue operation under such conditions.

In order to obviate such problems, the outflow amount $Q_2$ of driving liquid at the time of inflow of the slurry into the feed chambers is adapted to be selected from two flow amounts including one slightly larger than and the other slightly less than the inflow amount $Q_1$ of driving liquid at the time of outflow of the slurry from the feed chambers, and these two flow amounts are automatically switched to each other, so that $Q_1$ can be equal to $Q_2$ on an average.

In other words, in order to smoothly perform operation according to a time schedule shown in FIG. 2, change-over is repeated so that the outflow amount $Q_2$ of driving liquid is slightly larger than the inflow amount $Q_1$ thereof (e.g., $Q_2 = 1.05Q_1$) or the outflow amount $Q_2$ thereof is slightly less than the inflow amount $Q_1$ thereof (e.g., $Q_2 = 0.95Q_1$) through the mediums of a flow rate regulating valve $FC_2$, a valve $CV_2$ and a change-over device 17. One change-over is made at the time when a working time $t$ during which the change-over valve $A_1$ closes and $C_1$ is opened in the feed chamber 1 becomes less than a waiting time T preset by means of a waiting-time timer 16, whereby the outflow amount $Q_2$ is switched to one less than the inflow amount $Q_1$. The other change-over is made at the time when the working time $t$ during which the change-over valve $C_1$ is closed and the change-over valve $A_1$ is opened becomes less than said waiting time T, whereby the outflow amount $Q_2$ is switched to one larger than the inflow amount $Q_1$.

Additionally, in the case of normal operation performed by using three supplying chambers as described above, the inflow amount $Q_3$ of slurry flowing into the feed chambers may be substantially equal to the inflow amount $Q_1$ of driving liquid flowing into the feed chambers ($Q_3$ may be equal to $1.05Q_1$ or $1.05Q_4$, or $Q_3$ may be equal to $0.95Q_1$ or $0.95Q_4$).

However, in the case of operation performed by using two feed chambers, while the driving liquid flows into one feed chamber at a flow rate $Q_1$, a valve must be opened which is provided on a slurry inflow pipe of the other feed chamber and closed after completion of inflow of the slurry.

Consequently, if the opening time of the valve provided on the inflow pipe of slurry is $t_1$, and the effective volume of the inflow pipe is V, then the following related formula should be valid.

$$\frac{V}{Q_1} \geq \frac{V}{Q_3} + t_1$$

$$Q_3 \geq \frac{Q_1 \cdot V}{V - Q_1 \cdot t_1}$$

Therefore, it is necessary to make the flow amount $Q_3$ of slurry larger than the flow amount $Q_1$ of driving liquid.

In order to pressure-feed the same amount of slurry in emergency operation performed by using two feed chambers as that pressure-fed in normal operation performed by three feed chambers, a slurry pump having a large capacity must be installed in view of emergency operation and said pump should be normally operated with its discharge amount reduced. As a result, parts wear to an unduly high degree and operation with the resulting low pumping efficiency proves uneconomical.

Conversely, if a slurry pump having a proper discharge amount in normal operation is used, such disadvantages are presented that the amount of slurry to be pressure-fed in emergency operation will unavoidably be lowered, which may hamper other processes of operation.

In order to obviate the disadvantages described above, an additional feed chamber can be prepared previously so that a feed chamber to be repaired is separated from operation system by change-over of valves and the like and the slurry can be pressure-fed by using the remaining feed chambers and said reserve feed chamber. However, provision of a reserve feed chamber controlled for constant readiness presents such shortcomings that it is not only uneconomical but also requires an excessive installation space.

Further, as in FIG. 3 showing an external oblique view of a feed chamber portion in the slurry continuous pressure-feeding apparatus, an inflow pipe 4 of driving liquid for pressure-feeding the slurry to a transport pipe (not shown) and an outflow pipe 7 through which the driving liquid flows out as the slurry is filled into said feed chamber 1 are connected to the upper portion of said feed chamber 1 through expansion joints 18 and 19 respectively. Further, the pipes 4 and 7 are connected to change-over valves $A_1$ and $C_1$ (not shown).

Additionally, the driving liquid inflow pipe 4 and the driving liquid outflow pipe 7 are connected to the feed chamber 1 through a strut 20 for providing additional strength.

On the other hand, a slurry inflow pipe (not shown) for feed the slurry under low pressure and a slurry outflow pipe (not shown) for pressure-feeding the slurry under high pressure to the transport pipe (not shown) are connected to the lower portion of said feed chamber 1 respectively.

Further, the expansion joints 18 and 19 provided respectively between the driving liquid inflow pipe 4 and said feed chamber 1 and between the driving liquid outflow pipe 7 and said feed chamber 1 respectively comprise, as shown in FIG. 4, a case 21, a sleeve 22 coupled into said case 21 and a packing 24 coupled into the faying surfaces by means of a gland 23, whereby expansion or contraction of piping system due to thermal expansion of piping system is absorbed and leakage of the internal fluids is prevented.

However, said piping system as shown in FIG. 5, if the diameters of the respective pipes are represented by $d$, then a force W of $(\pi/4)\,d^2p$ is generated in the respective pipes which acts upward or downward with respect to the axis of pipe depending on the fluidic pressure $p$ of the driving liquid flowing through the driving liquid inflow pipe 4 or outflow pipe 7.

As a result, as shown in FIG. 6, the force acting on the feed chamber 1 through the strut 20 is 2W and a bending moment M acting on the feed chamber 1 becomes 2WL through the distance L to the point of application.

As the change-over valves $A_1$ and $C_1$ (not shown) are actuated, said bending moment M acts with the fluidic pressure $p$ being varied. Hence, construction of the feed chamber 1 has been designed to have sufficient rigidity to withstand the actions described above, thus resulting in an extremely high cost of production.

Additionally, there have been such disadvantage that troublesome works are required for maintenance and inspections on the packing portions 24 which are worn due to sliding movements caused between the case 21 and sleeve 22 respectively in the expansion joints 18 and 19.

Further, the conventional float for separating the slurry from the driving liquid in the feed chamber has been, as shown in FIG. 7, a hollow spherical body 25 provided at its exterior center portion with an annular member 26 disposed in opposite relationship to the inner wall of the feed chamber 1 and also installed at its bottom portion with a weight 27 for providing dynamical stability.

With the construction described above, there may occur some cases where the following two requirements required of a float cannot be met.

1. To have a specific gravity intermediate between the specific gravity of slurry and that a driving liquid.

2. To withstand the pressure in the supplying chamber.

The reason is that the outer diameter of the float is determined depending on the inner diameter of the feed chamber determined in proportion to the volume of slurry to be pressure-fed, and the wall thickness of float sufficient to withstand the pressure in the feed chamber is determined depending on said outer diameter, and hence, if the specific gravity is small, the float can be adjusted by the weight, but when the specific gravity of float is large, the float can not be adjusted. so that said first requirement cannot be met.

Additionally, the conventional float must have a reasonable wall thickness to maintain a proper strength. Since it is difficult to form a semispherical form of high accuracy solely by working by means of a press, machining has been applied to both internal and external surfaces of spherical body, thus resulting in increased cost of production.

Further, if the specific gravity of float is larger than the weight intermediate between the gravities of slurry and that of driving liquid and closer to the specific gravity of slurry, then the floats in condition in which the float is excessively sinking into the slurry, whereby the annular member 26 is buried into the slurry. In that case, solids contained in the slurry are caught in between the annular member 26 and the inner wall of feed chamber, thereby hampering movement of float and quickening wear of annular member 26. Therefore, the specific gravity of float must be adjusted such that the annular member 26 is brought just to the boundary faces of slurry and driving liquid. However, design and production of a spherical float have been found difficult because the position of annular member 26 is limited to the center line of the spherical body 25.

Furthermore, if it is attempted to increase and expand the transport amount of slurry by using the conventional slurry continuous pressure-feeding apparatus, then the pressure in the feed chambers is elevated. Consequently, it becomes imperative to make walls of the feed chambers to have sufficient thickness to withstand the high pressure.

As a result, it has been difficult for an ordinary float detector such as a proximity switch, with its performance to detect from outside of the feed chamber the position of float floating at the boundary faces between the slurry and driving liquid. Even if special design is devised, there have been technical limitations to it and it has unavoidably involved very high expenses.

OBJECT OF THE INVENTION

The first object of the present invention is to provide a slurry continuous pressure-feeding apparatus wherein in the case of repairing one feed chamber, the slurry can be continuously pressure-fed without decreasing concentration of the slurry to be pressure-fed and efficiency in transportation of said slurry by using the other two feed chambers.

Additionally, the second object of the present invention is to provide a slurry continuous pressure-feeding apparatus wherein thermal expansion of piping system is absorbed and bending moment is eliminated which is caused to the feed chambers due to the fluidic pressure of driving liquid flowing through the pipes.

Further, the third object of the present invention is to provide a float easily designed and produced for use in a slurry continuous pressure-feeding apparatus.

Still further, the fourth object of the present invention is to provide a slurry continuous pressure-feeding apparatus wherein position detecting of float can be performed accurately and inexpensively.

DESCRIPTION OF THE PREFERRED EMBODIMENT

Description will hereunder be given on an embodiment of the slurry continuous pressure-feeding apparatus according to the present invention with reference to the drawings.

Like parts as have been shown in FIGS. 1 to 7 are indicated by like numerals with no descriptions given thereto.

Figure 1:
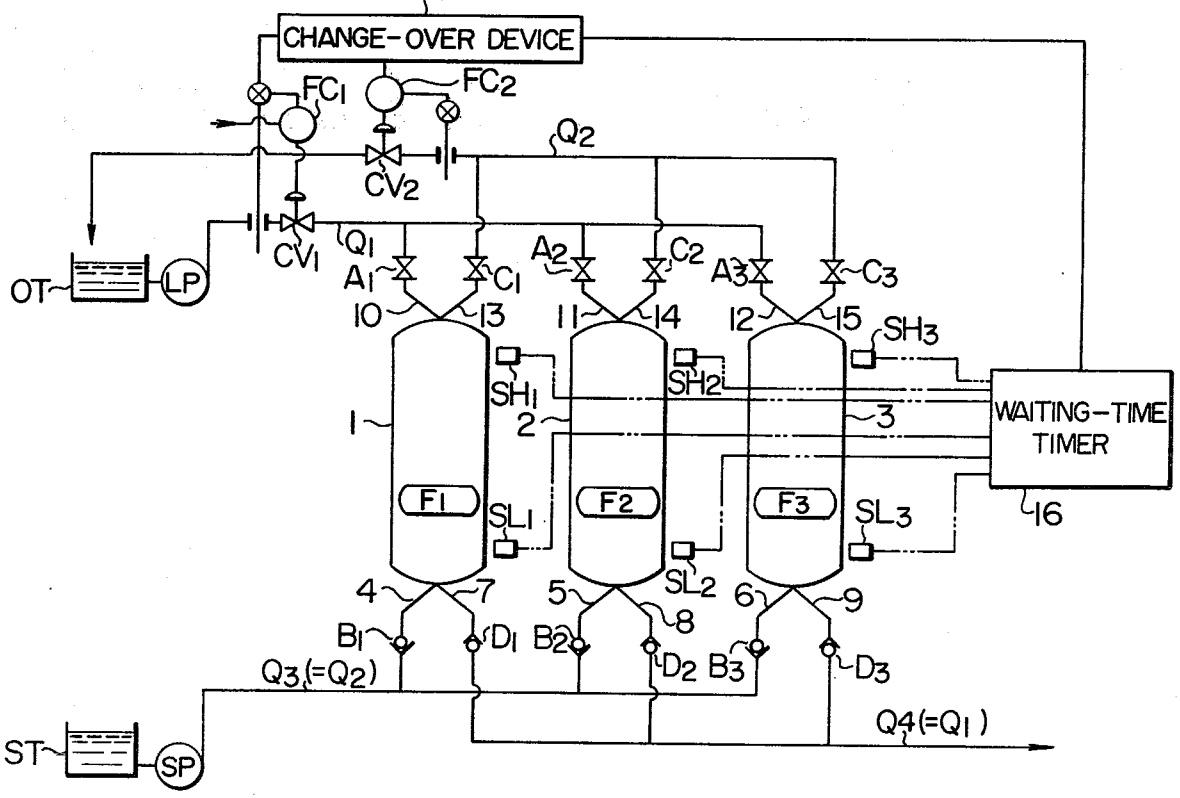
FIG. 1 PRIOR ART
FIG. 1 is an explanatory view of the conventional slurry continuous pressure-feeding apparatus.
Figure 2:
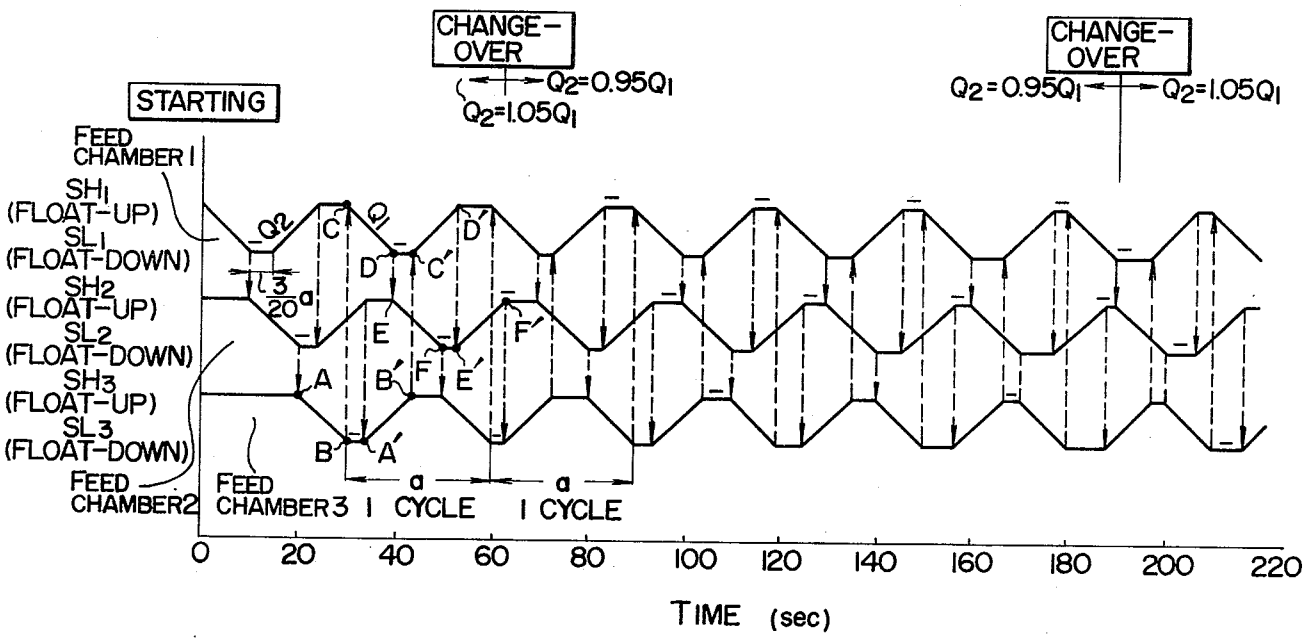
FIG. 2 PRIOR ART
FIG. 2 is a block diagram for explaining a operation time schedule of the apparatus shown in FIG. 1.
Figure 3:
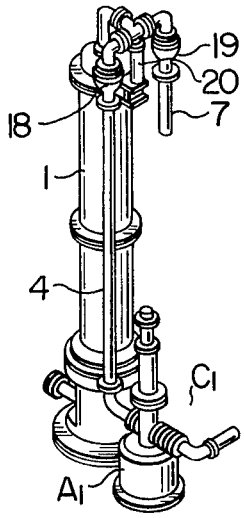
FIG. 3 PRIOR ART
FIG. 3 is an external oblique view of the feed chamber portion shown in FIG. 1.
Figure 4:
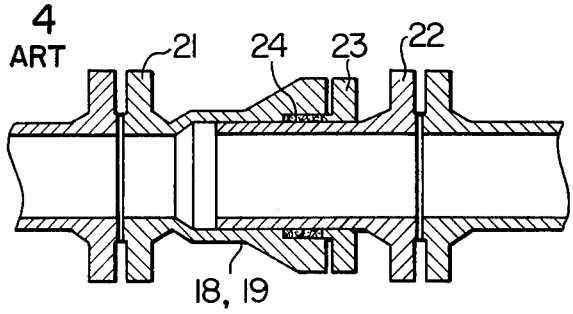
FIG. 4 PRIOR ART
FIG. 4 is a longitudinal sectional view for explaining the expansion joint portion of FIG. 3.
Figure 5:
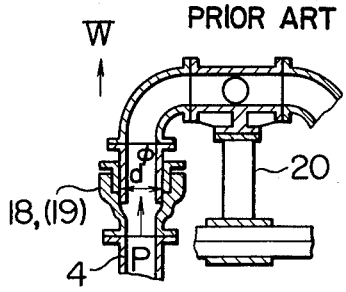
FIG. 5 PRIOR ART
FIGS. 5 and 6 are drawings for explaining the generating process of bending moment acting on a feed chamber in the conventional slurry continuous pressure-feeding apparatus.
Figure 6:
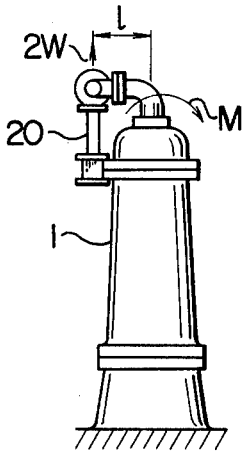
FIG. 6 PRIOR ART
Figure 7:
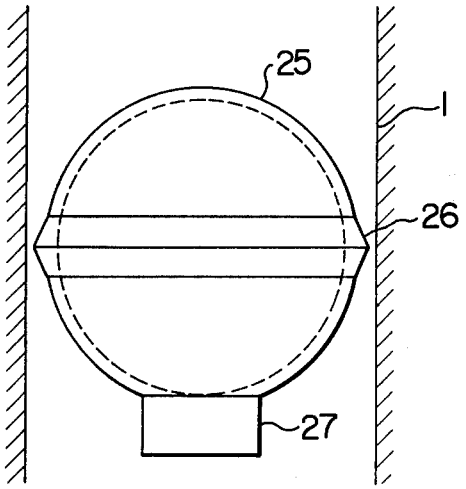
FIG. 7 PRIOR ART
FIG. 7 is an explanatory view of the conventional float applied to the slurry continuous pressure-feeding apparatus.
Figure 8:
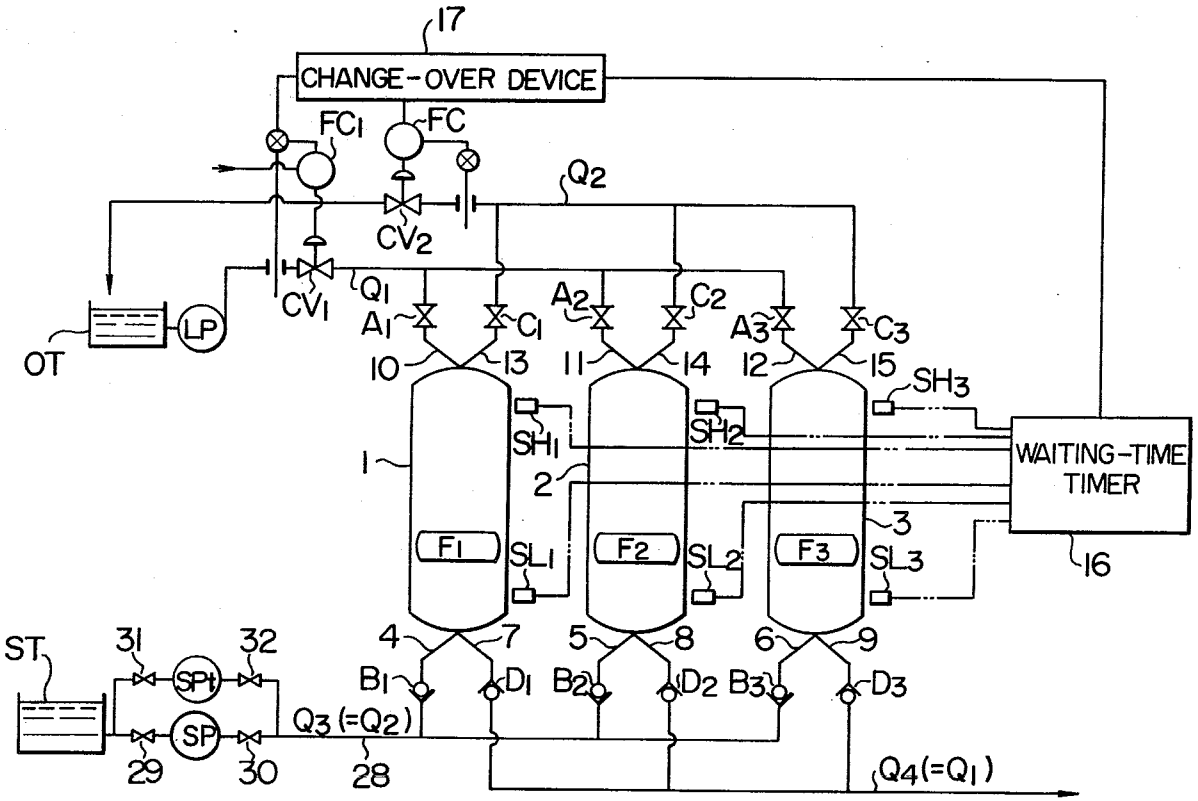
FIG. 8 is a schematic view of the slurry continuous pressure-feeding apparatus according to the present invention and also an explanatory view of installation of the auxiliary slurry pump.

FIG. 8 is an explanatory view of installation of the auxiliary pump in the slurry continuous pressure-feeding apparatus according to the present invention.

A slurry pump SP is connected to the intermediate portion of a pipe conduit 28 feeding the slurry from a tank ST into feed chambers 1 to 3 through open-and-closing valves 29 and 30 which are normally open. Further, an auxiliary slurry pump SO*t* is in parallel with a removably connected to said slurry pump SP through open-and-closing valves 31 and 32 which are normally closed.

In the case of pressure-feeding of slurry by using two feed chambers out of the feed chambers 1 to 3, a valve $CV_2$ provided on an outflow pipe of driving liquid is maintained in open condition, a driving liquid pump LP is operated continuously, and the slurry pump SP and auxiliary slurry pump SP*t* are operated in normal operation and shut-off operation. In other words, pressure-feeding of slurry can be performed continuously by the operation according to the time schedule shown in FIG. 9.

Figure 9:
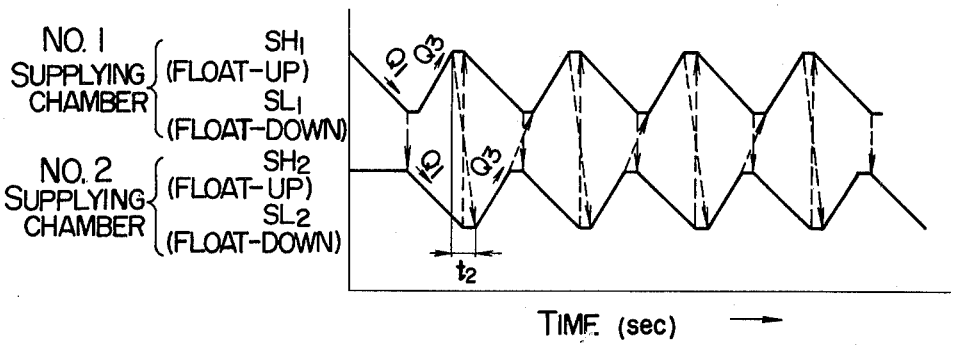
FIG. 9 is a block diagram for explaining a time schedule in the case of two feed chambers being used in FIG. 8.

Additionally, movements of the slurry and driving liquid in every feed chamber are given as an ordinate and the time (sec.) is given as an abscissa in FIG. 9. A solid line slanted downward to right indicates the feed of driving liquid and a solid line slanted upward to right the charging of slurry respectively. A broken line indicates open-and-closing orders given to the respective change-over valves.

In comparing discharge amounts $Q_3$ of slurry pump between in normal operation and emergency operation, i.e., in operation of three feed chambers and operation of two feed chambers, if the effective volume V of feed chambers is 64 liters (l), the open-and-closing time *t* of change-over valve 3 sec., the transport volume $Q_3$ of slurry 8 l/sec., the ratio FC between the supply amount $Q_3$ of slurry and the transport amount $Q_4$ thereof (or the ratio between the inflow and outflow amounts of driving liquid $Q_2/Q_1$) 1.05 for example, the discharge amount $Q_3$ of slurry pump in the case of operation of three supplying chambers is given by:

$$Q_3 = FC \times Q_4 = 1.05 \times 8 = 8.4 \text{ l/sec.}$$

and in the case of operation of two feed chambers, the discharge amount $Q_3$ is given by:

$$Q_3 \geq \frac{Q_4 \times V}{V - Q_1 \times t} = \frac{8 \times 64}{64 - 8 \times 3} = 12.8 \text{ l/sec.}$$

Consequently, in the case of operation by using the conventional apparatus, it is imperative to constantly prepare a slurry pump capable of discharging more than 12.8 l/sec., which must be operated in the low discharging region in normal operation, i.e., operation by using three feed chambers. According to the present invention, if the discharge amounts of the respective slurry pumps connected each other in parallel are set at 8.4 l/sec., either of the two slurry pumps can be operated in normal operation and two slurry pumps in parallel can be operated in emergency operation, i.e., operation by using two feed chambers so that the slurry pump or pumps can constantly operate within the proper discharge region.

The slurry pumps SP and SP*t* operate in normal and shut-off operations alternatively and repeatedly. If the time shut-off operation $t_2$ is set about at several minutes, then there will be no danger of sedimentation of slurry which may block up the transport pipe.

Figure 10:
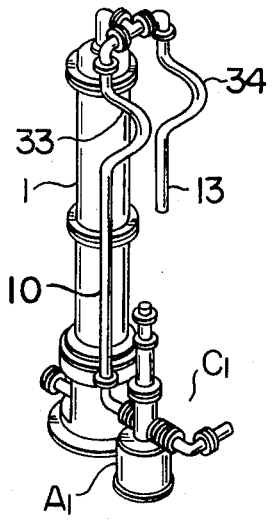
FIG. 10 is an external oblique view of the feed chamber portion in the slurry continuous pressure-feeding apparatus according to the present invention.
Figure 11:
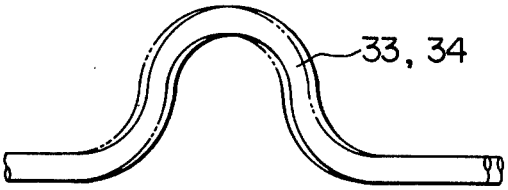
FIG. 11 is an explanatory view of the bending pipe portion in FIG. 10.
Figure 12:
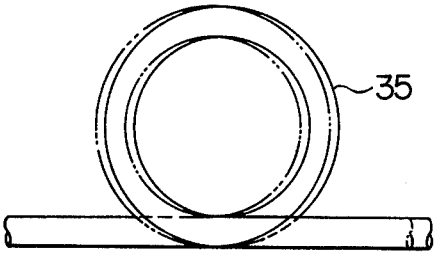
FIG. 12 is an explanatory view of another embodiment of the bending pipe portion shown in FIG. 10.

FIG. 10 is an external oblique view of the supplying chamber portion in the slurry continuous pressure-feeding apparatus according to the present invention. FIGS. 11 and 12 are explanatory views of the bending pipe portion shown in FIG. 10.

In FIG. 10, the respective intermediate portions of the driving liquid inflow pipe 10 and outflow pipe 13 connecting the feed chamber 1 to change-over valve $A_1$ and $C_1$ (not shown) are formed of bending pipe portions 33 and 34 in the form of Ω.

With the arrangement described above, the bending pipe portions 33 and 34 in the form of Ω can readily absorb thermal expansion by being deformed flexibly as shown by two-dot chain lines in FIG. 11, if thermal expansion due to changes of temperature occur with the respective pipes 4 and 7. Furthermore, the pipes 4 and 7 made of continuous material respectively, and hence, the fluidic pressure is balanced as internal pressure in the pipes, so that the bending moment acting on the feed chamber disappears. Even in the case of the bending pipe portion 35 being formed in the form of l, substantially the same functional effects can be obtained as in the case of the pipe in the form Ω described above.

Figure 13:
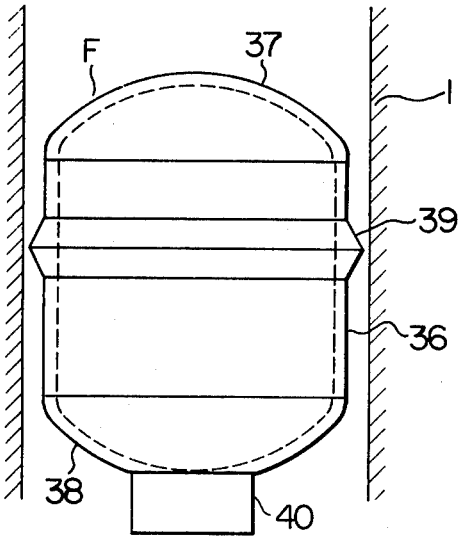
FIG. 13 is an explanatory view of the float applied to the slurry continuous pressure-feeding apparatus according to the present invention.

FIG. 13 is an explanatory view of the float applied to the slurry continuous pressure-feeding apparatus according to FIG. 13. Referring to the drawing, the body of a float F is formed in the form of a cylindrical body 36 closely attachingly provided at both upper and lower ends thereof with bowl-shaped end plates 37 and 38 made by means of a press. The body 35 is provided on the outer surface thereof with an annular member 39 disposed in opposite relationship to the inner wall of the feed chamber 1, and the lower end late 38 is provided or formed at its lower portion with a weight 40.

The wall thickness of said body 36 and end plate 37, 38 are determined depending on the dimensions of the body 36 and end plates 37, 38 and the pressure in the feed chamber 1, and the length of the body 36 is determined such that the entire float is adjusted to have a specific gravity intermediate between the specific gravity of slurry and that of driving liquid.

Additionally, the position of the annular member 39 in vertical direction can be adjusted so as to meet the boundary faces of slurry and driving liquid.

Figure 14:
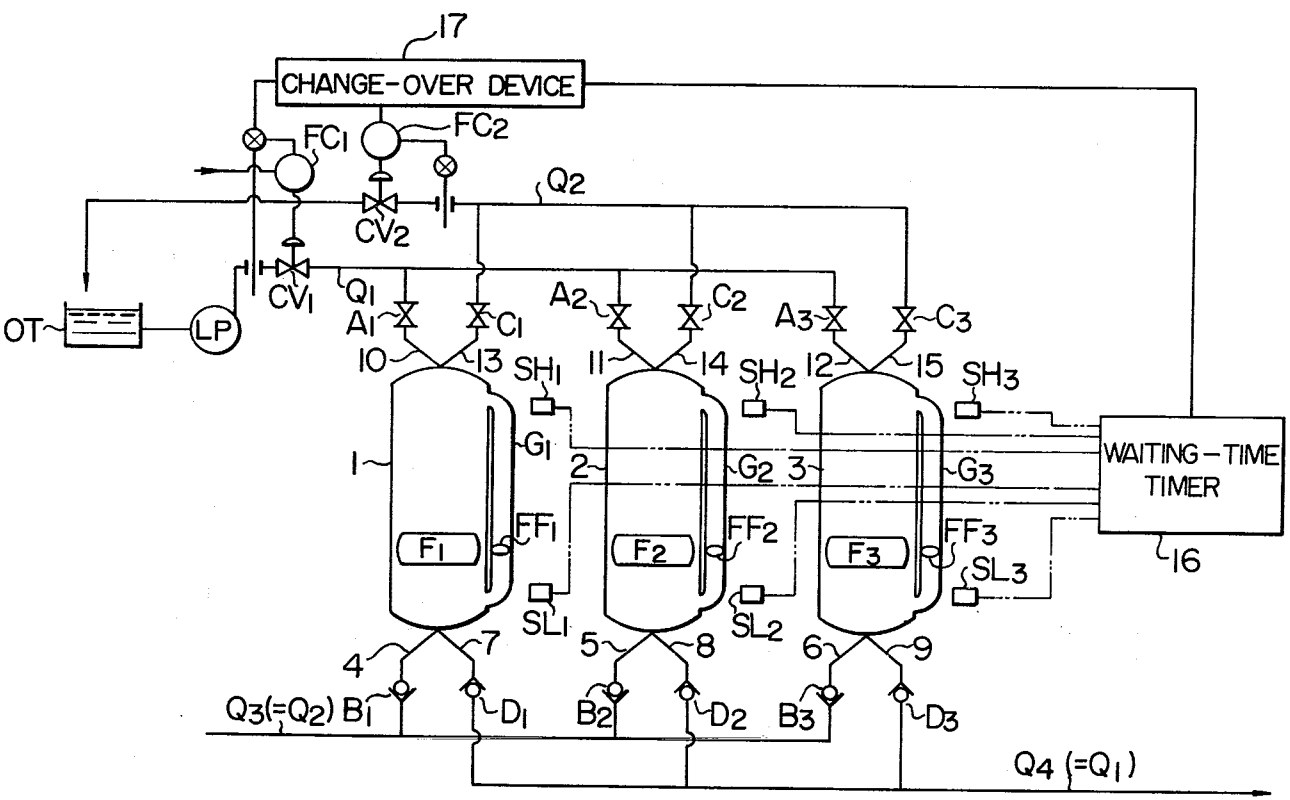
FIG. 14 is a schematic view for explaining the slurry continuous pressure-feeding apparatus according to the present invention and also an explanatory view of position detecting of float.

FIG. 14 is an explanatory view of the simple float position detector device in the slurry continuous pressure-feeding apparatus according to the present invention.

Referring to the drawing, if description is given on the feed chamber 3 for example, the upper portion of the feed chamber 3 and the lower portion thereof are maintained in communication with each other through a branch pipe $G_3$ having an inner diameter less than that of the feed chamber 3. Inserted in said branch pipe $G_3$ at the boundary faces of slurry and driving liquid is a float $FF_3$ whose specific gravity is selected to be the same as the specific gravity of the float $F_3$ inserted in the feed chamber 3. The positions of $FF_3$, i.e., the uppermost and lowermost positions of boundary faces of slurry and driving the liquid are detected by a float detector disposed at the outer circumferential portion of a branch pipe $G_3$, such as proximity switches of $SH_3$, $SL_3$. Additionally, the float $F_3$ works so as to prevent mixing of the slurry with the driving liquid.

As has been described in detail, according to the present invention, the following results can be obtained.

1. In case one feed chamber is out of order, the same amount of slurry can be pressure-fed by using two feed chambers as in the case of three feed chambers being used. Hence, no reserve feed chamber is required, thereby proving economical and reducing installation space.

2. Thermal expansion of piping system is readily absorbed by the bending pipe portion, bending moment caused to the feed chambers by the fluidic pressure of driving liquid disappears, and sliding worn parts of the expansion joints are not required. Hence, no maintenance and inspections are required.

3. The body and end plates of float can be separately fabricated, with the result that production of float is extremely easy. Particularly, the end plates are made by means of a press, resulting in noticeably decreased cost.

Additionally, the position of the annular member disposed in opposite relationship to the inner wall of feed chamber can be adjusted to meet the boundary faces of the slurry and driving liquid, thereby permitting to design and produce under ideal conditions.

4. Since the diameter of the branch pipe for conveniently detecting the position of float is smaller than the inner diameter of feed chamber wall thickness of the branch pipe can be made small. As the result, an inexpensive proximity switch available commercially can be applied to the float detector, detecting reliability can be improved, and further elevated pressure and increased capacity in slurry transportation can be attained. Further, only the float detecting portion of the branch pipe can be made of non-magnetic material such as stainless steel which is convenient for detecting and feed chambers can be made of inexpensive material such as steel plate, thereby reducing the production cost considerably.

What is claimed is:

1. In a slurry continuous pressure-feeding apparatus comprising three feed chambers arranged in parallel with one another and each having a float disposed in the interior thereof, a high-pressure pump adapted to deliver driving liquid to each of said feed chambers, a main slurry pump adapted to feed a slurry to each of said feed chambers, check-valves mounted in slurry inflow pipes and slurry outflow pipes and change-over valves mounted in driving liquid inflow pipes and driving liquid outflow pipes, detectors adapted to detect the upper and lower limits of said floats and open and close said change-over valves, a waiting timer adapted to detect a minimum opening and closing time for the two change-over valves provided to each of said feed chambers, and a change-over device for adjusting the inflow amount and the outflow amount of the driving liquid, the improvement comprising an auxiliary slurry pump connected removably in parallel with said main slurry pump through the agency of opening-and-closing valves said main slurry pump and said auxiliary slurry pump being rendered operative conjointly when two of the three feed chambers are used to continuously pressure-feed the slurry whereby the same amount of slurry that can be fed when all the three feed chambers are used can be fed by using two feed chambers.

2. Apparatus comprising a plurality of feed chambers, driving fluid supply means for supplying driving fluid under pressure, driven fluid supply means for supplying driven fluid under pressure, driving fluid inlet and outlet means for admitting driving fluid to and exhausting driving fluid from each of the respective feed chambers, driven fluid inlet and outlet means for admitting driven fluid to and exhausting driven fluid from each of the respective feed chambers.

and inlet and outlet control means for controlling said inlet and outlet means to effect admission of driven fluid into a feed chamber during exhaustion of driving fluid from said same feed chamber, followed by exhaustion of driven fluid from said same feed chamber during admission of driving fluid to said same feed chamber with the pressure of said driving fluid being applied to raise the pressure of said driven fluid, wherein said drive fluid supply means includes:

driven fluid reservoir means, driven fluid line means leading to the respective driven fluid inlet means of said feed chambers, a main driven fluid pump and an auxiliary driven fluid pump interposed between said driven fluid reservoir means and said driven fluid line means, and pump control means for selectively operationally disconnecting said auxiliary pump with only said main pump being operationally connected to pump driven fluid from said driven fluid reservoir to said driven line means when a first number of said feed chambers are operational and with both said main and auxiliary pumps being operationally connected to pump driven fluid from said driven fluid reservoir to said driven line means when a different number then said first number of said feed chambers are operational.

3. Apparatus according to claim 2, wherein said main and auxiliary pumps are arranged parallel to one another in the flow line of said driven fluid.

4. Apparatus according to claim 3, wherein said main and auxiliary pumps have equal pumping capacities.

5. Apparatus according to claim 2, wherein a total of three feed chambers are provided which are arranged in parallel to one another, and wherein said first number is three and said different number is two.

6. Apparatus according to claim 5, wherein said main and auxiliary pumps are arranged parallel to one another in the flow line of said driven fluid.

7. Apparatus according to claim 6, wherein said main and auxiliary pumps have equal pumping capacities.

8. Apparatus according to claim 5, wherein said main and auxiliary pumps are constructed to provide equal total quantities of flow of driven fluid for operation with three and two feed chambers.

9. Apparatus according to claim 2, wherein said main and auxiliary pumps are constructed to provide equal total quantities of flow of driven fluid for operation with three and two feed chambers.

* * * * *